United States Patent [19]

Marchadour

[11] 4,401,238

[45] Aug. 30, 1983

[54] DEVICES USED FOR FILLING CONTAINERS

[76] Inventor: Jean-Charles Marchadour, La Feuilleraie Kerbascol, Saint Jean Trolimon, France, 29120

[21] Appl. No.: 254,047

[22] Filed: Apr. 14, 1981

[30] Foreign Application Priority Data

Apr. 16, 1980 [FR] France ..... 80 08534

[51] Int. Cl.[3] ..... B65B 3/10; B26D 5/14

[52] U.S. Cl. ..... 222/80; 83/199; 83/580; 137/330; 141/125; 222/554; 251/315

[58] Field of Search ..... 141/125, 392; 83/199, 83/580; 137/330; 251/315; 222/548, 554, 563, 80

[56] References Cited

U.S. PATENT DOCUMENTS 2,302,404 11/1942 Troy, Jr. ..... 137/330
3,157,190 11/1964 Allen ..... 137/330
3,228,412 1/1966 Peterson .

FOREIGN PATENT DOCUMENTS 1434460 3/1964 France .
2086969 12/1971 France .
458184 8/1968 Switzerland .

*Primary Examiner*—David A. Scherbel
*Attorney, Agent, or Firm*—Ostrolenk, Faber, Gerb & Soffen

[57] ABSTRACT

A device for filling a container comprises an endpiece provided with an inner conduit equipped at its end with a ball-valve having a through passage and pivotable in the endpiece about a diametral axis transverse to the passage. An annular member having an external face coplanar with the frontal surface of the endpiece, has an inner spherical surface held in permanent contact with the external face of the ball-valve. The annular member is mounted for rotation with respect to the endpiece about the longitudinal axis of the conduit. At least part of the intersection line between the passage and the external surface of the ball-valve cooperates in cutting relationship with an edge of the external face of the annular member while the latter is rotating and the valve is pivoting to close the conduit.

10 Claims, 2 Drawing Figures

2
1b
3
6a
5
A
6
2a
9
15
17
10
14
11
18

DEVICES USED FOR FILLING CONTAINERS

This invention relates to horn devices used in the canning industry for filling containers with the meat and the like.

The canning of foodstuffs such as sausage meat, minced meat or the like, containing in particular fairly large pieces of meat, is achieved by means of automatic devices which determine the quantity of product to be introduced in each can and cut from the roll of product introduced.

The devices used up to now have solved satisfactorily a number of problems which can arise in the canning of this type of product and particularly problems related to proportioning the product and to the quality of the canning. One of the most delicate problems to solve however resides in the meat roll cutting operation and in being able to obtain a smooth enough and non-overflowing free surface of the product in its container, in order to facilitate the subsequent container-closing operations.

Several devices, known in this particular field as horns, are currently used which are not altogether satisfactory where the canning and finishing operations are concerned. All of them are designed so as to penetrate through to the bottom of the container before releasing the product and so as to begin by filling up the bottom and to move the horn gradually out of the container as the level of the product raises up inside the container, thus preventing any air inclusion inside the can.

Some such devices for example comprise, inside the horn, a plunger which pushes a predetermined quantity of product inside a packing conduit provided in said horn and which constitutes a closing valve for a lateral supply inlet to the packing conduit. The valve can be moved in rotation, in order to facilitate the cutting of the product vertically to that opening. The main disadvantage of this arrangement resides in the fact that the product which is pushed out, sticks strongly to the plunger. Also, this arrangement is ill-suited to filling up tall cans at high speed.

In other devices, the horn outlet is closed off by a valve which has the disadvantage of impeding the passage of the product.

It is also known to close off the orifice by means of a closing off blade which covers it up or uncovers it while at the same time cutting off the roll of product.

The knife is rather eccentric with respect to the axis of the tube and as a result the container cannot be filled from a central zone. The same applies with a known horn in which the closing off and cutting are achieved by a casing external to the horn and the bottom of which is provided with an eccentric orifice which may or may not be placed to correspond with the outlet orifice. Consequently, its use is limited to cylindrical containers.

Finally, one other known device comprises as a closing member a ball-valve or a rotary cylindrical member with a passage provided therethrough. In the case of the ball-valve, the edges of the through passage cooperate with a casing external to the horn to cut the product. The casing is provided with a bottom constituting a bearing for the ball-valve. The casing can be imparted with rotational movement. Also, in this case, the horn is only suitable to fill cylindrical containers.

It should also be noted that with the devices with either a ball-valve or a blade, it is not possible to obtain a smooth surface of the canned products.

It is the aim of the present invention to overcome these disadvantages by proposing an improvement to filling horns with closing-ball-valves.

To this effect, the invention relates to an improvement in devices for filling a container with a pasty product or with a pasty product containing large pieces, or inclusions which device comprises means for propelling a predetermined quantity of product into an outlet conduit provided in an endpiece of which the cross-section complements that of the container to be filled. The conduit is equipped at its end with a member adapted to close it and also to cut the roll of product released. The member consists of a ball-valve provided with a through passage and rotatable in the endpiece about a diametral axis, transverse to the passage. A cutting edge of the member being defined by at least part of the intersecting line between the passage and the external surface of the ball-valve, cooperates with an edge of the endpiece defined by the line of intersection between a frontal external plane surface of the endpiece and an inner surface corresponding to the external surface of the ball-valve for which the inner surface constitutes a bearing. Means are provided to control the pivoting movement of the ball-valve about its pivoting axis between a position opening the conduit and a position closing it. According to one main characteristic of the invention, the edge of the endpiece is provided on an annular member, the external face of which is contained in the frontal surface of the endpiece while the inner face comprises a spherical surface held permanently in contact with the external surface of the ball-valve, the annular member being mounted for rotation with respect to the endpiece about the longitudinal axis of the conduit.

In a preferred embodiment of the invention the annular member comprises on its external lateral edge, a gear wheel adapted to cooperate with a pinion carried by a longitudinal spindle rotatably mounted inside the endpiece.

Advantageously, the ball-valve further presents an external flat situated within the plane of the frontal surface of the endpiece when the ball-valve is in the closed position.

It should also be noted that the through passage widens out on the side opposite the cutting edge.

The invention will be more readily understood on reading the following description with reference to the accompanying drawings, in which:

In FIG. 1 the ball-valve is open;

In FIG. 2 the ball-valve is closed.

The horn illustrated in these figures is essentially constituted of an inner core 1 adapted to fit inside an outer tubular endpiece or casing 2. When fitted one inside the other, the core 1 and the tubular casing 2 are locked together by means not shown. The core 1 is composed of two half-shells 1*a* and 1*b* joined together by means of screws 1*c*. The half-shells define on the inside a cylindrical conduit 3, their overall external surface being likewise cylindrical, of a diameter substantially equal to the inner diameter of the tubular casing 2. It will be noted that the external cylinder is non-restrictively eccentric with respect to the inner conduit, the half-shell 1*a* being provided with elements for controlling the operation of the horn which will be described hereafter. The tubular casing 2 is provided at its front with a frontal wall 2*a* presenting an orifice 4 which is adapted to be aligned with the conduit 3.

Figure 1:
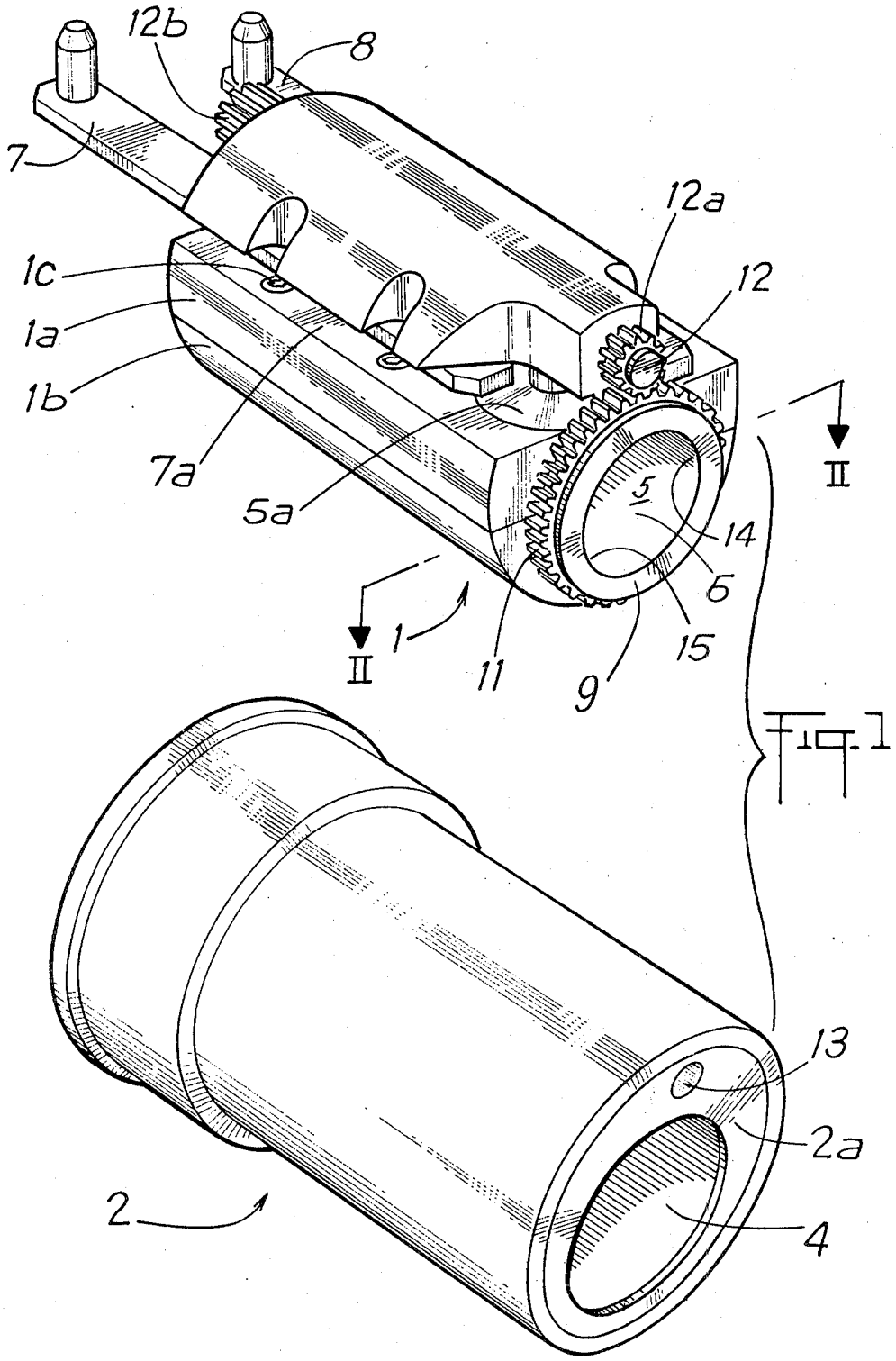
FIG. 1 is a perspective view of an endpiece or filling horn equipped with the improvement according to the invention with the core assembly separated from the casing.
Figure 2:
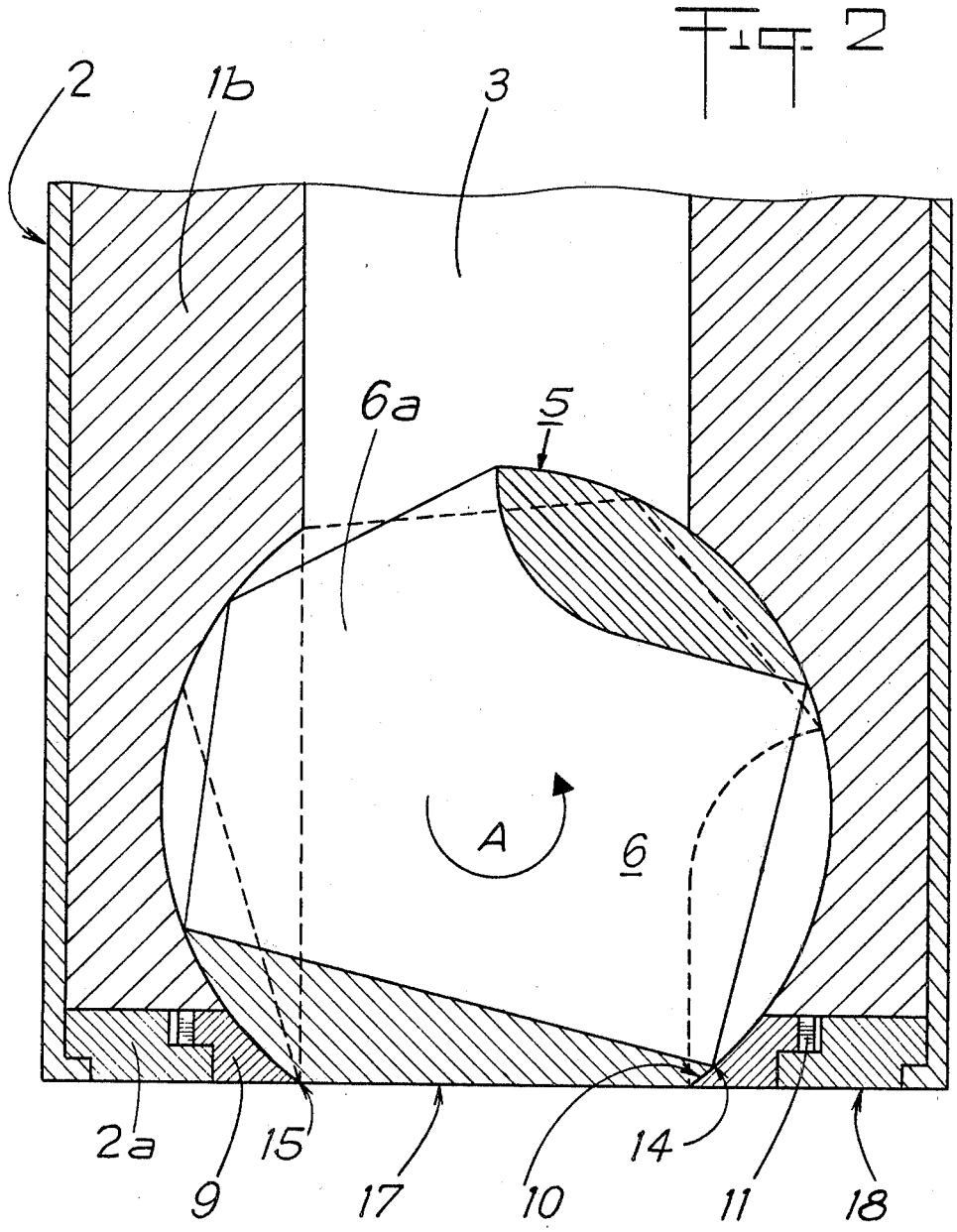
FIG. 2 is a partial longitudinal cross-section, along the line II—II of FIG. 1 and looking in the direction of arrows II—II, of the apparatus of FIG. 1 when the core and casing are assembled.

At the front end of the conduit 3 is placed a ball-valve 5 pivotally mounted in the core 1 about a diametral axis perpendicular to the junction-plane of the two shells, i.e. perpendicular to the plane of FIG. 2. A through passage 6 is cut in the ball-valve 5 which can extend the conduit 3 as shown in FIG. 1 in a first position of the ball-valve 5 about its pivoting axis or which can be placed substantially perpendicular to the said conduit as shown in FIG. 2. The ball-valve 5 then operates as a closing member for the conduit 3.

These operations of the ball-valve 5 are controlled by two rods 7 and 8 mounted free in longitudinal slots 7*a* provided in the half-shell 1*a* and hinged on the ball-valve 5 at the level of the flats 5*a* which the ball-valve comprises perpendicularly to its pivoting axis. The free ends of the rods 7 and 8 are adapted to be joined to a driving member not shown.

On the frontal face of the core 1 there is provided an annular member 9 with a spherical recess 10 in its centre, issuing of the same radius as that of the ball-valve 5. Thus, the said annular member is centered on the ball-valve 5 and is held in contact thereon by the frontal wall 2*a* of the tubular casing 2 when the core 1 is fitted therein. Member 9 is therefore free to rotate about an axis corresponding to that of the conduit 3 and is externally provided with teeth 11.

A spindle 12 is adapted to rotate in a longitudinal recess provided in the half-shell 1*a*. Spindle 12 is equipped at its ends with pinions 12*a* and 12*b*, the pinion 12*a* meshing with the teeth 11 and the pinion 12*b* cooperating with a member driving it in rotation and not shown. It will be noted that spindle 12 is held in position at one of its ends by a bearing 13 provided in the wall 2*a* of the casing 2. Another bearing is provided closer to the pinion 12*b* in the longitudinal recess of the half-shell 1*a*.

It will be noted in connection with the ball-valve 5 that the intersection 14 of the passage 6 constitutes an edge of which one part cooperates with the edges of the spherical recess of the member 9 and which are constituted by the intersection 15 of the recess with the external face of member 9. The intersection is sharpened to form a cutting blade and the two edges 14 and 15 cooperate together to form a cutting member for the product released through the end of the horn when the ball-valve moves from its position shown in broken lines in FIG. 2 to its position shown in solid lines in the same figure, in the direction of arrow A. The cutting is done very neatly as the edge 15 moves due to the member 9 being driven in rotation by the spindle 12.

It will also be noted that the ball-valve 5 is provided with an external flat 17 which, when the conduit 3 is closed, is contained inside the plane of the external face 18 of the wall 2*a* of the tubular casing 2. This arrangement gives the horn a protrusion-free frontal surface, thereby leaving a very smooth surface on the product. This absence of protrusions makes it possible for the upper ends of the container to scrape the end of the horn.

Finally, it should be noted that the passage 6 has its inlet end 6*a* greatly widened, thus avoiding shearing the product at the level of that end between the core 1 and the ball-valve 5, which shearing could considerably damage the pieces of product which could be crushed without being entirely cut.

The foregoing description is given in relation to a horn of external cylindrical shape. It serves to illustrate one great advantage of the invention which is that it comprises a rotary cutting member rotating independently of the fixed external casing, the outer shape of the horn is immaterial and can correspond to any shape of containers found on the market. And generally speaking, the invention is not limited to the description given hereinabove, but on the contrary covers any variants that come within the scope of the claims.

What is claimed is:

1. An apparatus for filling a container with a pasty product which may contain large inclusions, said apparatus comprising:

an endpiece having a cross-section which complements a cross-section of the container, said endpiece having an external plane frontal surface having an opening through which said product may pass;

first means within said endpiece defining an outlet conduit positioned to the rear of said frontal surface and adapted to receive a predetermined quantity of said product which is propelled into said outlet conduit at the rear thereof, said outlet conduit having an open front end from which said product may enter said container;

an annular member aligned with the opening in said frontal surface and having an opening through which product in said conduit may pass, said annular member having an external face disposed in a common plane with said frontal surface of said endpiece; said annular member being mounted for rotation with respect to said endpiece about the longitudinal axis of the conduit;

means for causing said annular member to rotate;

a valve member disposed at the front of said conduit and adapted to close the latter, said valve member provided with a passage through which said product may pass; said valve member adapted to pivot relative to said first means; said valve member having an external surface which cooperates with an inner surface of said annular member, said inner surface forming a bearing surface for said valve member;

said valve member having a cutting edge defined by at least part of a line of intersection between said passage and said external surface of said valve member, said cutting edge cooperating with an edge of said annular member defined by a line of intersection between said external face of said annular member and said inner surface of said annular member; and means for controlling pivoting of said valve member about said axis between a first position in which said conduit is open and a second position in which said conduit is closed by said valve member, with said valve member being pivotable while said annular member is rotating.

2. The apparatus of claim 1, wherein said valve member is a ball valve.

3. The apparatus of claim 2, wherein said passage widens out towards an end opposite said cutting edge.

4. The apparatus of claim 1, in which said means for causing said annular member to rotate comprises:

a longitudinal spindle rotatably mounted within said casing;

a pinion carried at the end of said longitudinal spindle;

a gear wheel mounted on an external lateral edge of said annular member and in mesh with said pinion, whereby said annular member rotates when said longitudinal spindle rotates.

5. The apparatus of claim 4, wherein said passage widens out towards an end opposite said cutting edge.

6. The apparatus of claim 1, in which said valve member pivots within said casing about an axis through a diameter of said valve member and transverse to said passage.

7. The apparatus of claim 6, wherein said passage widens out towards an end opposite said cutting edge.

8. The apparatus of claim 1, wherein the valve member presents an external flat surface situated within said common plane when the valve member is in said second position.

9. The apparatus of claim 8, wherein said passage widens out towards an end opposite said cutting edge.

10. The apparatus of claim 1, wherein said passage widens out towards an end opposite said cutting edge.

* * * * *